US008125125B2

(12) United States Patent
Liu et al.

(10) Patent No.: US 8,125,125 B2
(45) Date of Patent: Feb. 28, 2012

(54) LIGHT SOURCE MODULE

(75) Inventors: Yu-Ju Liu, Taipei (TW); Yi-Hung Chen, Taipei (TW); Chien-Chang Pei, Taipei (TW)

(73) Assignee: Everlight Electronics Co., Ltd., New Taipei (TW)

( * ) Notice: Subject to any disclaimer, the term of this patent is extended or adjusted under 35 U.S.C. 154(b) by 0 days.

(21) Appl. No.: 12/775,478

(22) Filed: May 7, 2010

(65) Prior Publication Data

US 2011/0074268 A1 Mar. 31, 2011

(30) Foreign Application Priority Data

Sep. 30, 2009 (TW) ..... 98133262 A

(51) Int. Cl.
*H01J 1/02* (2006.01)

(52) U.S. Cl. ..... 313/46; 313/45

(58) Field of Classification Search ..... 313/45, 313/46.011, 11, 46
See application file for complete search history.

(56) References Cited

U.S. PATENT DOCUMENTS

| | | | | |
|---|---|---|---|---|
| 7,868,525 | B2 * | 1/2011 | Liu et al. | 313/25 |
| 2007/0008723 | A1 | 1/2007 | Hampton | |
| 2009/0230834 | A1 * | 9/2009 | Liu | 313/12 |
| 2009/0261705 | A1 * | 10/2009 | Lai | 313/11 |

FOREIGN PATENT DOCUMENTS

| | | | |
|---|---|---|---|
| CN | 201028447 | Y | 2/2008 |
| CN | 201110529 | Y | 9/2008 |
| TW | M294616 | | 7/2006 |
| TW | I290777 | | 12/2007 |
| TW | M330426 | | 4/2008 |
| TW | M337673 | | 8/2008 |
| TW | I307752 | | 3/2009 |

* cited by examiner

*Primary Examiner* — Vip Patel
(74) *Attorney, Agent, or Firm* — Jianq Chyun IP Office

(57) ABSTRACT

A light source module including a heat dissipation block, a light emitting diode (LED) package and a circuit board is provided. The heat dissipation block has a surface and the LED package is disposed on the surface of the heat dissipation block. The circuit board is electrically connected to the LED package, and the circuit board and the LED package are located at two opposite sides of the heat dissipation block respectively.

9 Claims, 4 Drawing Sheets

LIGHT SOURCE MODULE

CROSS-REFERENCE TO RELATED APPLICATION

This application claims the priority benefit of Taiwan application serial no. 98133262, filed on Sep. 30, 2009. The entirety of the above-mentioned patent application is hereby incorporated by reference herein and made a part of specification.

BACKGROUND OF THE INVENTION

1. Field of the Invention

The present invention relates to a light source module, and more particularly to a light source module with a light emitting diode package used as a light emitting device.

2. Description of Related Art

With progress in semiconductor technologies, current light emitting diode (LED) can emit lights with high luminance and has the advantages of low power consumption, compactness, low driving voltage, and so forth. Therefore, the LED has been widely applied in the field of illumination.

Typically, when the LED emits lights with high luminance, it generates high thermal energy. If the thermal energy cannot be transmitted away and keeps on accumulating within the LED, the temperature of the LED is continuously increased. Therefore, the over heated LED leads to the luminance of the LED fading away and the decreasing of the lifetime of the LED and even the permanent damage of the LED. Hence, the current illumination using the LED is equipped with the heat sink to dissipate the heat generated by the LED.

However, in the conventional LED light source module, the LED is disposed on the circuit board and the circuit board having the LED thereon is disposed on the heat sink. The heat conducted onto the heat sink from the LED is conducted away through the air current generated by the fan. Nevertheless, the circuit board usually has the insulating layers thereon to insulate the wire layers from each other, and the insulating layers are poor thermal conductors. Therefore, the thermal conducting rate of conducting the heat of the LED to the heat sink through the circuit board is seriously affected and the heat dissipation efficiency of the LED light source module is poor.

SUMMARY OF THE INVENTION

The present invention provides a light source module having a relatively better heat dissipation efficiency.

One embodiment of the present invention provides a light source module including a heat dissipation block, a light emitting diode package and a circuit board. The heat dissipation block has a surface and the light emitting diode package is disposed on the surface of the heat dissipation block. The circuit board is electrically connect to the light emitting diode package, and the circuit board and the light emitting diode package are disposed at two opposite sides of the heat dissipation block respectively.

In one embodiment of the present invention, the light source module further comprises at least a conductive device electrically connected to the light emitting diode package and the circuit board.

In one embodiment of the present invention, the heat dissipation block has a recess for disposing the light emitting diode package therein, and the conductive device penetrates through the heat dissipation block, and the light emitting diode package is electrically connected to one end of the conductive device.

In one embodiment of the present invention, the light source module further comprises at least an insulating ring circling the conductive device and electrically insulating the conductive device from the heat dissipation block.

In one embodiment of the present invention, the conductive device is a conductive pillar. One end of the conductive pillar away from the light emitting diode package protrudes from the insulating ring and has a protruding edge, and a radius of an outer periphery of the protruding edge is larger than a radius of an inner periphery of the insulating ring.

In one embodiment of the present invention, the light source module further comprises at least a conductive line, and one end of the conductive line winds between the insulating ring and the protruding edge, and the other end of the conductive line is connected to the circuit board.

In one embodiment of the present invention, the heat dissipation block has a solder point. The light emitting diode package is configured on the heat dissipation block by being soldered on the solder point.

In one embodiment of the present invention, the light source module further comprises a lamp cup, wherein the heat dissipation block is configured on the lamp cup, and a fan is configured between the heat dissipation block and the lamp cup, and the circuit board is configured in the lamp cup.

In one embodiment of the present invention, the light source module further comprises a connector electrically connected to the circuit board and fixed on the lamp cup.

In one embodiment of the present invention further provides a light source module including a heat dissipation block, a light emitting diode package and a fan module. The heat dissipation block has a surface and the light emitting diode package is disposed on the surface of the heat dissipation block. The fan module and the light emitting diode package are disposed at two opposite sides of the heat dissipation block respectively. The fan module has an opening, a blade and a baffle plate circling the opening. The blade is disposed in the opening for generating an air current. The air current in the opening flows along a flowing direction to dissipate the heat of the heat dissipation block. The baffle plate prevents the air current from flowing along a direction opposite to the flowing direction.

In one embodiment of the present invention, the light source module further comprises a circuit board electrically connected to the light emitting diode package, wherein the circuit board and the heat dissipation block are disposed at two opposite sides of the fan module respectively.

In one embodiment of the present invention, the light source module further comprises a connector electrically connected to the circuit board.

In one embodiment of the present invention, the light source module further comprises a lamp cup, wherein the fan module and the heat dissipation block are configured on the lamp cup, and the heat dissipation block is configured on the fan module.

Accordingly, in the light source module of the embodiment of the present invention, since the light emitting diode package is configured on the surface of the heat dissipation block, the heat generated by the light emitting diode package can be directly conducted to the heat dissipation block without being blocked by the circuit board. Therefore, the light source module of the embodiment of the present invention possesses a relatively better heat dissipation efficiency. Moreover, in the light source module of the embodiment of the present invention, because the fan module has the baffle plate to prevent the air current from flowing along a direction opposite to the flow direction of the air current in the opening and to further improve the heat convection, the light source module possesses a relatively better heat dissipation efficiency.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
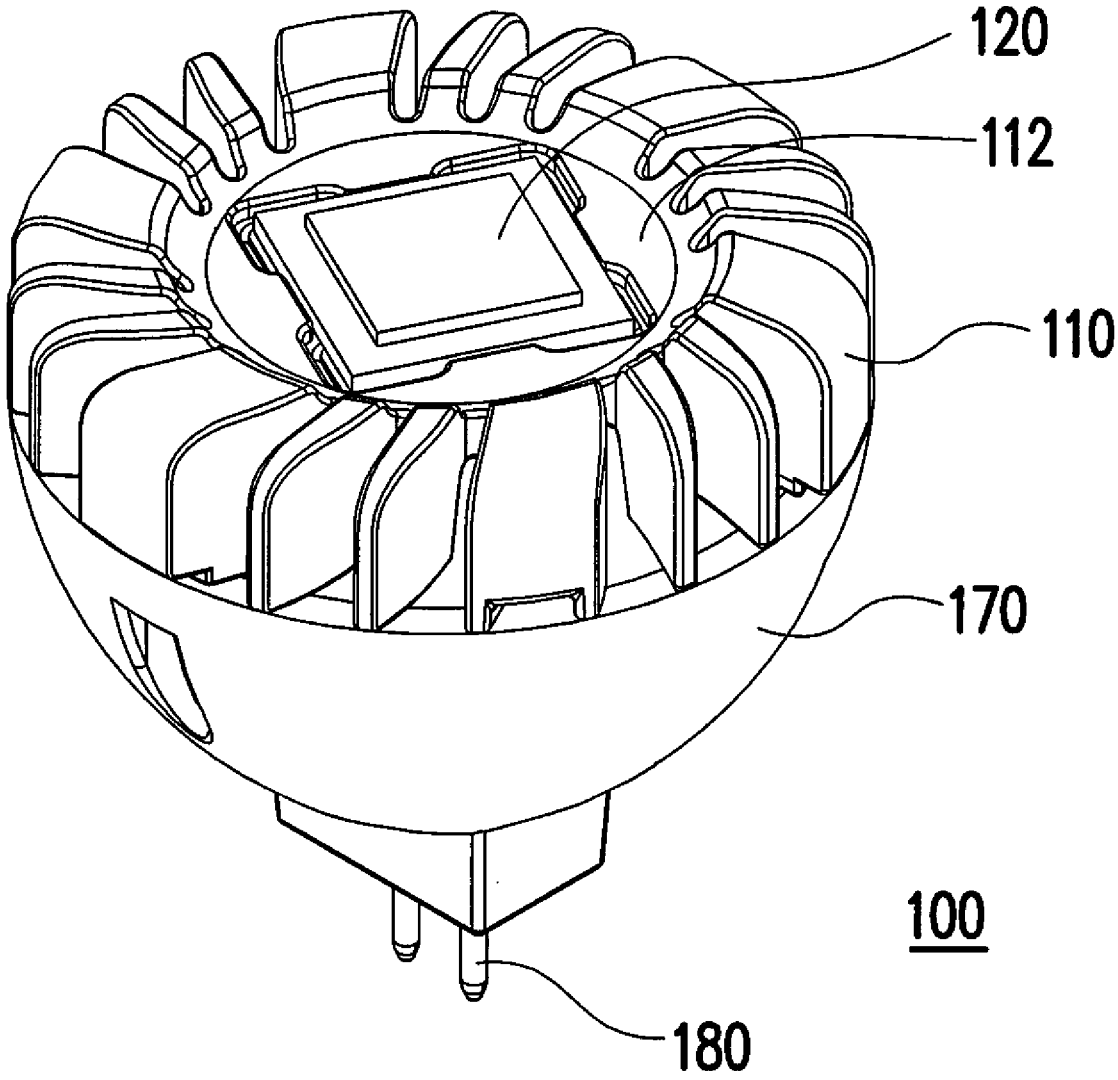
FIG. 1 is a schematic view of a light source module according to one embodiment of the present invention.
Figure 2:
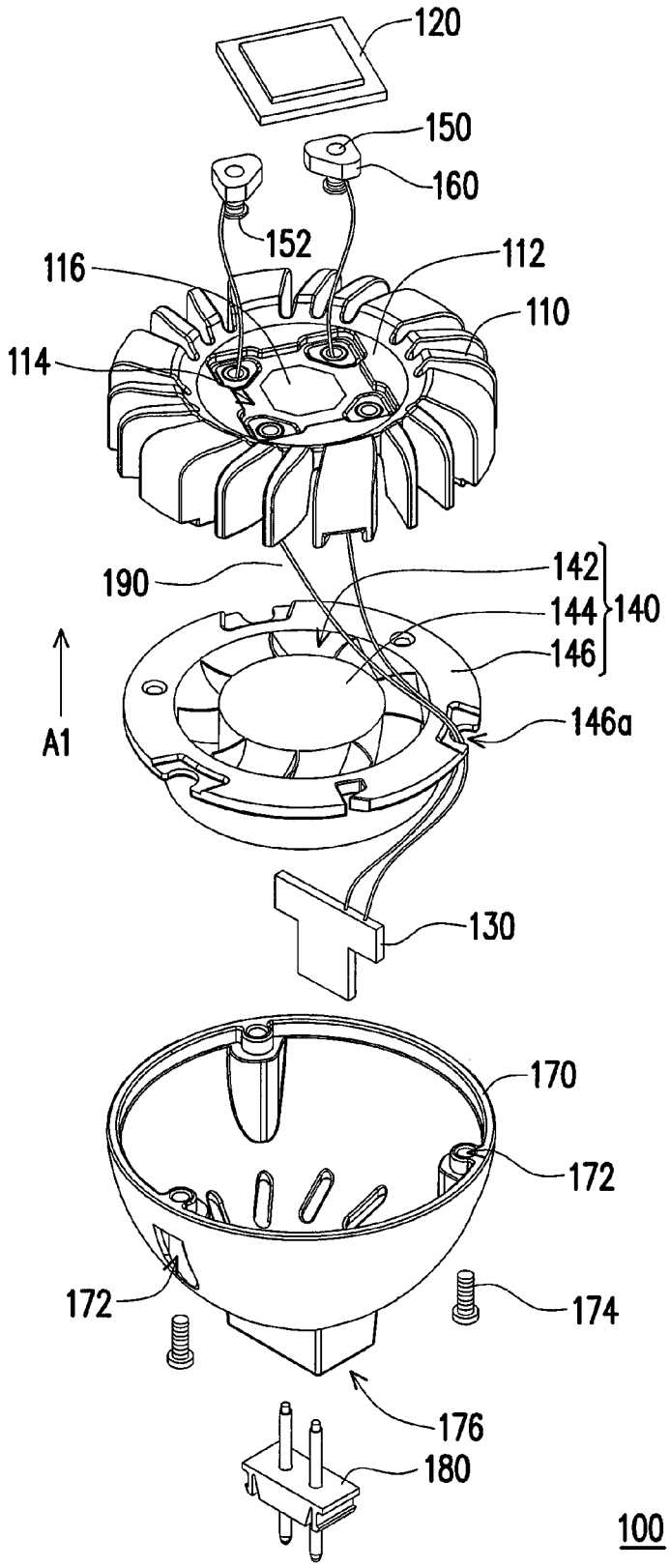
FIG. 2 is an exploded view of the light source module in FIG. 1.

FIG. 1 is a schematic view of a light source module according to one embodiment of the present invention. FIG. 2 is an exploded view of the light source module in FIG. 1. As shown in FIG. 1 and FIG. 2, a light source module 100 of the present embodiment includes a heat dissipation block 110 and a light emitting diode package 120. The heat dissipation block 110 has a surface 112 and the light emitting diode package 120 is disposed on the surface 112 of the heat dissipation block 110. In the present embodiment, the light source module 100 further comprises a circuit board 130 electrically connected to the light emitting diode package 120 and a fan module 140. The light emitting diode package 120 and the circuit board 130 are disposed on two opposite sides of the heat dissipation block 110 respectively and the fan module 140 is disposed between the heat dissipation block 110 and the circuit board 130.

More specifically, the fan module 140 has an opening 142 and a blade 144 disposed in the opening 142. The blade 144 is adapted to generating an air current. The air current in the opening 142 flows along a flowing direction A1 to dissipate the heat of the heat dissipation block 110. Hence, the heat generated by the light emitting diode package 120 on the surface 112 of the heat dissipation block 110 can be carried away by the air current to avoid the light emitting diode package 120 from being over heated. Thus, the light emitting efficiency and the lifetime of the light emitting diode package 120 can be improved.

In order to obtain a relatively better heat dissipation effect, the fan module 140 of the present invention has a baffle plate 146 circling the opening 142. The baffle plate 146 can prevent the air current from flowing along a direction opposite to the flowing direction A1 so as to keep the thermal air contact with the heat dissipation block 110 from flowing back and to further improve the heat convection. Therefore, the light source module 100 of the present embodiment has better heat dissipation efficiency. It should be noticed that the flowing direction A1 of the air current in the opening 142 is not limited by the direction drawn in FIG. 2. In other embodiments, the flowing direction of the air current in the opening can be opposite to the flowing direction A1 shown in FIG. 2.

In addition, in the present embodiment, the heat dissipation block 110 can have a solder point 116. The material of the heat dissipation block 110 can be, for example but not limited to, solder material. Specifically, the material of the solder point 116 can be, for example, nickel. The light emitting diode package 120 can be configured on the heat dissipation block 110 by being soldered on the solder point 116, and nickel is adapted to soldering with the solder material. For instance, the light emitting diode package 120 can combine with the heat dissipation block 110 by using the surface mount technology (SMT) to enhance a manufacturing efficiency of the light source module 100.

Figure 3:
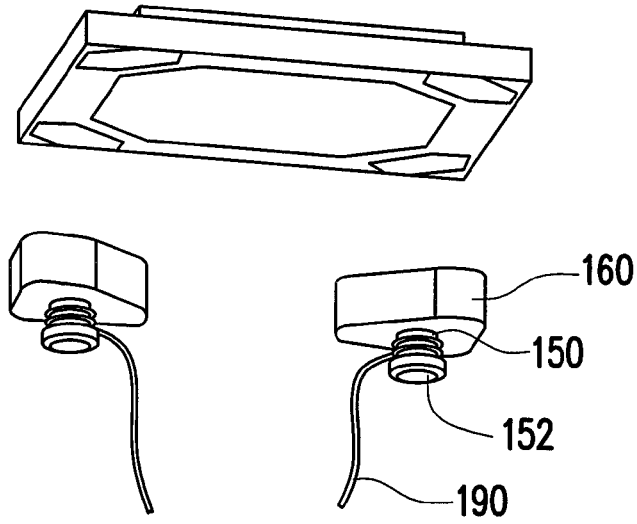
FIG. 3 is a schematic enlarged view showing the conductive device of FIG. 1 equipped with the light emitting diode package.

FIG. 3 is a schematic enlarged view showing the conductive device of FIG. 1 equipped with the light emitting diode package. As shown in FIG. 1, FIG. 2 and FIG. 3, in the present embodiment, the light source module 100 further comprises two conductive devices 150, two insulating rings 160 and two conductive lines 190. The conductive devices 150 can be, for example, conductive pillars electrically connected to the light emitting diode package 120 and the circuit board 130. The heat dissipation block 110 has a recess 114 for disposing the light emitting diode package 120 therein, and the conductive devices 150 penetrate through the heat dissipation block 110, and the light emitting diode package 120 is electrically connected to one end of each of the conductive devices 150.

Furthermore, the insulating rings 160 circles the corresponding conductive devices 150 respectively so as to electrically insulate the conductive devices 150 from the heat dissipation block 110. In addition, the other end of each of the conductive devices 150, which is far away from the light emitting diode package 120, protrudes from the insulating ring 160 and has a protruding edge 152. In the present embodiment, the radius of the outer periphery of each protruding edge 152 is larger than the radius of the inner periphery of each insulating ring 160 so that one end of the conductive lines 190 can securely wind between the insulating rings 160 and the protruding edges 152 without being easily falling off.

In the present embodiment, the baffle plate 146 has a through hole **146*a* formed by indenting a portion of the outer periphery of the baffle plate 146. One end of each conductive line 190 winds between the insulating ring 160 and the protruding edge 152, and the other end of each conductive line 190 passes through the through hole 146*a* and is connected to the circuit board 130 so that the light emitting diode package 120** is electrically connect to the circuit board.

Figure 4:
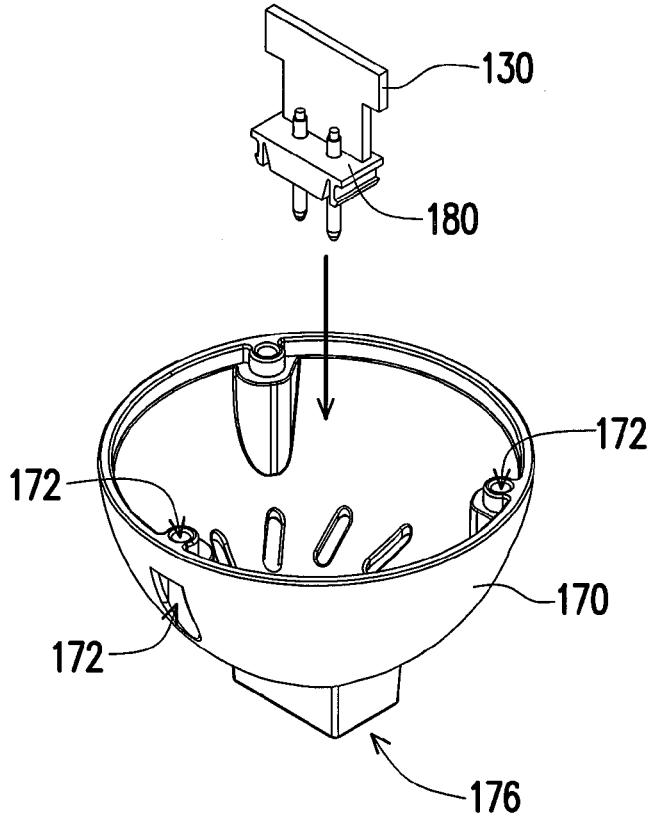
FIG. 4 is a schematic view of the lamp cup in the light source module of FIG. 1 before the lamp cup is assembled.
Figure 5:
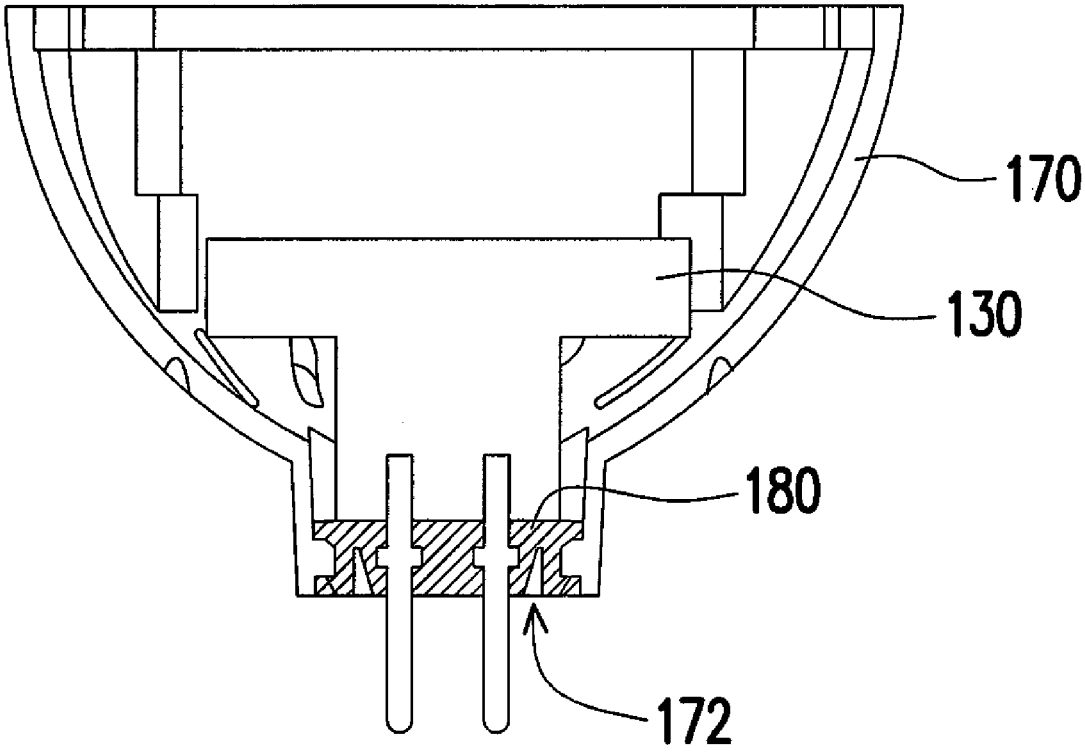
FIG. 5 is a schematic view of the lamp cup in the light source module of FIG. 1 after the lamp cup is assembled.

FIG. 4 is a schematic view of the lamp cup in the light source module of FIG. 1 before the lamp cup is assembled. FIG. 5 is a schematic view of the lamp cup in the light source module of FIG. 1 after the lamp cup is assembled. As shown in FIG. 1, FIG. 4 and FIG. 5, in the present embodiment, the light source module 100 further comprises a lamp cup 170 and a connector 180 fixed on the lamp cup 170, and the connector 180 is electrically connected to the circuit board 130 in the lamp cup 170. The fan module 140 and the heat dissipation block 110 are configured on the lamp cup 170, and the heat dissipation block 110 is configured on the fan module 140.

As shown in FIG. 2, FIG. 4 and FIG. 5, more specifically, the fan module 140 and the heat dissipation block 110 can be, for example, locked on the lamp up 170. The lamp cup 170 can have a plurality of assembling holes 172. A plurality of fixing pieces 174 can pass through the assembling holes 172 respectively to lock the lamp cup 170 and the fan module 140 on the heat dissipation block 110.

In addition, the lamp cup 170 can have a slot 176. During the assembly of the light source module 100, the connector

180 can be buckled in the slot 176 so that the connector 180 can be stably configured in the lamp cup 170.

Accordingly, in the light source module of the embodiment of the present invention, since the light emitting diode package is configured on the surface of the heat dissipation block, the heat generated by the light emitting diode package can be directly conducted to the heat dissipation block without being blocked by the circuit board. Therefore, the light source module of the embodiment of the present invention possesses a relatively better heat dissipation efficiency. Moreover, in the light source module of the embodiment of the present invention, because the fan module has the baffle plate to prevent the air current from flowing along a direction opposite to the flow direction of the air current in the opening and to further improve the heat convection, the light source module possesses a relatively better heat dissipation efficiency.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A light source module, comprising:

a heat dissipation block having a surface;

a light emitting diode package disposed on the surface of the heat dissipation block;

a fan module, wherein the fan module and the light emitting diode package are disposed at two opposite sides of the heat dissipation block respectively, and the fan module has an opening, a blade and a baffle plate circling the opening, and the blade is disposed in the opening for generating an air current, and the air current in the opening flows along a flowing direction to dissipate the heat of the heat dissipation block, and the baffle plate prevents the air current from flowing along a direction opposite to the flowing direction; and a circuit board electrically connected to the light emitting diode package, wherein the circuit board and the heat dissipation block are disposed at two opposite sides of the fan module.

2. The light source module of claim 1 further comprising at least a conductive device electrically connected to the light emitting diode package and the circuit board.

3. The light source module of claim 2, wherein the heat dissipation block has a recess for disposing the light emitting diode package therein, and the conductive device penetrates through the heat dissipation block, and the light emitting diode package is electrically connected to one end of the conductive device.

4. The light source module of claim 2, further comprising at least an insulating ring circling the conductive device and electrically insulating the conductive device from the heat dissipation block.

5. The light source module of claim 4, wherein the conductive device is a conductive pillar, and an end of the pillar away from the light emitting diode package protrudes from the insulating ring and has a protruding edge, and a radius of an outer periphery of the protruding edge is larger than a radius of an inner periphery of the insulating ring.

6. The light source module of claim 5, further comprising at least a conductive line, and one end of the conductive line winds between the insulating ring and the protruding edge, and the other end of the conductive line is connected to the circuit board.

7. The light source module of claim 1, wherein the heat dissipation block has a solder point, and the light emitting diode package is configured on the heat dissipation block by being soldered on the solder point.

8. The light source module of claim 1, further comprising a lamp cup, wherein the heat dissipation block is configured on the lamp cup, and a fan is configured between the heat dissipation block and the lamp cup, and the circuit board is configured in the lamp cup.

9. The light source module of claim 8, further comprising a connector electrically connected to the circuit board and fixed on the lamp cup.

* * * * *